US006955279B1

(12) United States Patent
Mudd et al.

(10) Patent No.: US 6,955,279 B1
(45) Date of Patent: Oct. 18, 2005

(54) CARRYING ASSEMBLY AND METHOD FOR SECUREMENT OF ELECTRONIC DEVICES

(75) Inventors: John J. Mudd, Overland Park, KS (US); Jonathan C. Burrell, Olathe, KS (US); John B. Whiteside, Lenexa, KS (US); David Lammers-Meis, Prairie Village, KS (US)

(73) Assignee: Garmin Ltd., (KY)

( * ) Notice: Subject to any disclaimer, the term of this patent is extended or adjusted under 35 U.S.C. 154(b) by 159 days.

(21) Appl. No.: 10/310,097

(22) Filed: Dec. 4, 2002

(51) Int. Cl.[7] ..... A45F 5/00

(52) U.S. Cl. ..... 224/197; 24/3.11; 24/3.7; 24/505; 24/507; 224/269; 224/670; 224/930

(58) Field of Search ..... 224/197, 269, 224/669, 670, 912, 930; 417/234; 24/3.11, 24/3.12, 3.7, 3.9, 498, 505, 507

(56) References Cited

U.S. PATENT DOCUMENTS

| | | | | | |
|---|---|---|---|---|---|
| 3,261,519 | A | * | 7/1966 | Horne | 224/911 |
| 5,201,858 | A | * | 4/1993 | Otrusina | 224/197 |
| 5,347,693 | A | * | 9/1994 | Otrusina | 24/3.12 |
| 5,452,497 | A | * | 9/1995 | Peng | 24/3.11 |
| 5,535,928 | A | | 7/1996 | Herring | 224/250 |
| 5,653,336 | A | | 8/1997 | Buonaiuto et al. | 206/320 |
| 5,668,869 | A | | 9/1997 | Zinno | 379/449 |
| 5,730,342 | A | | 3/1998 | Tien | 224/271 |
| 5,768,371 | A | | 6/1998 | Snyder | 379/446 |
| 5,806,146 | A | * | 9/1998 | Chen | 24/3.11 |
| 5,850,954 | A | | 12/1998 | Dong-Joo | 224/197 |
| 5,988,577 | A | * | 11/1999 | Phillips et al. | 224/197 |
| 5,996,184 | A | | 12/1999 | Mah et al. | 24/3.12 |
| 6,006,969 | A | | 12/1999 | Kim | 224/197 |
| 6,098,858 | A | | 8/2000 | Laugesen | 224/197 |
| 6,161,741 | A | * | 12/2000 | French | 224/912 |
| 6,182,878 | B1 | | 2/2001 | Racca | 224/605 |
| 6,206,257 | B1 | | 3/2001 | Peele et al. | 224/197 |
| 6,283,348 | B1 | | 9/2001 | Wang | 224/271 |
| 6,357,641 | B1 | | 3/2002 | Cheng | 224/242 |
| 6,367,672 | B1 | | 4/2002 | Lind | 224/245 |
| 6,454,146 | B2 | | 9/2002 | Alis | 224/250 |
| 6,752,299 | B2 | * | 6/2004 | Shetler et al. | 224/197 |

* cited by examiner

*Primary Examiner*—Gary E. Elkins
(74) *Attorney, Agent, or Firm*—Devon A. Rolf

(57) ABSTRACT

A carrying assembly (10,110) having an easy release clip for carrying of an electronic device (12,112) is disclosed. In both a first and a second preferred embodiment, the easy release clip of the carrying assembly (10,110) allows a user to insert and remove the electronic device (12,112) in one step and without having to depress a release key. In the first preferred embodiment, the carrying assembly (10) is adjustable so that the electronic device (12) may be positioned in a horizontal position, a vertical position, or any position between horizontal and vertical. The carrying assembly (10) broadly comprises a rear panel (14), a spring component (16) including an integral leaf spring (46), a retainer button (18), and a base (20). In a second preferred embodiment, the carrying assembly (110) is fitted to a lanyard so that the electronic device (112) may be worn around the user's neck. The carrying assembly (110) broadly comprises a base (114), a catch (116), an actuator (118), and a rear panel (120) having an integral leaf spring (256).

19 Claims, 5 Drawing Sheets

CARRYING ASSEMBLY AND METHOD FOR SECUREMENT OF ELECTRONIC DEVICES

BACKGROUND OF THE INVENTION

1. Field of the Invention

The present invention relates to carrying assemblies for securing or carrying portable electronic devices. More particularly, the present invention relates to a carrying assembly operable to quickly and easily release an electronic device from the carrying assembly and to adjustably position the device in a preferred position.

2. Description of Prior Art

Portable electronic devices are well-known in the art, examples of which include mobile telephones, pagers, personal digital assistants ("PDAs"), global positioning system ("GPS") receiver units, etc. One problem presented with carrying such an electronic device is securement of and accessibility to the electronic device. A user of the electronic device desires to carry the electronic device in such a manner to prevent dropping, misplacing, or damaging the electronic device, while at the same time maintaining quick access to the electronic device.

Prior art carrying assemblies use holders that may be clipped to the user's clothing, such as the user's belt or a waist of the user's pants. Unfortunately, these devices are often cumbersome and do not allow quick access to the electronic device. For example, some carrying assemblies are not easily removable from the belt or pants. Also, when the user sits, the electronic device often pushes into the user's torso. Furthermore, the carrying assembly and the electronic device are often obstructed from reach, such as when a safety belt is used in an automobile.

Accordingly, there is a need for a carrying assembly for an electronic device that overcomes the limitations of the prior art. Specifically, there is a need for a carrying assembly that offers reliable securement of the electronic device while allowing the user to quickly and easily remove the electronic device from the carrying assembly.

Furthermore, there is a need for a carrying assembly that is adjustable so that the user may rotate the electronic device to a comfortable position once the device is in the carrying assembly and clipped to the user's clothing.

There is yet a further need for a carrying assembly that allows the user immediate access to the electronic device, such as when the user is reading navigational information from a GPS unit.

SUMMARY OF THE INVENTION

A carrying assembly of the present invention overcomes the above-identified problems and provides a distinct advance in the art of carrying assemblies for electronic devices. More particularly, a first preferred embodiment of the present invention provides a carrying assembly that includes a rear panel, a spring component, a retainer button, and a base for securely clipping the assembly and the device to a user's clothing, such as the user's belt or a waist of the user's pants. The carrying assembly also includes a plurality of serrated teeth provided on a locking button and the retainer button for rotational adjustment of the electronic device by the user so that the user may rotate the assembly to a comfortable position. Furthermore, the carrying assembly provides for receipt of the locking button in a U-shaped flange of the base for quick and easy removal of the electronic device from the carrying assembly. Specifically, the locking button allows the user to remove the electronic device in one step using only one hand and without depressing a release button. Additionally, the carrying assembly of the first preferred embodiment is made of only four parts, thus permitting simpler and less expensive construction.

In a second preferred embodiment, the carrying assembly includes a lanyard so that it may be worn around a user's neck and so that the user may immediately access the electronic device with minimal effort. Additionally, the carrying assembly of the second preferred embodiment is operable to allow the user to quickly and easily remove the electronic device from the carrying assembly in one step and with only one hand.

BRIEF DESCRIPTION OF THE DRAWINGS

Preferred embodiments of the present invention are described in detail below with reference to the attached drawing figures, wherein.

BRIEF DESCRIPTION OF THE PREFERRED EMBODIMENTS

Figure 1:
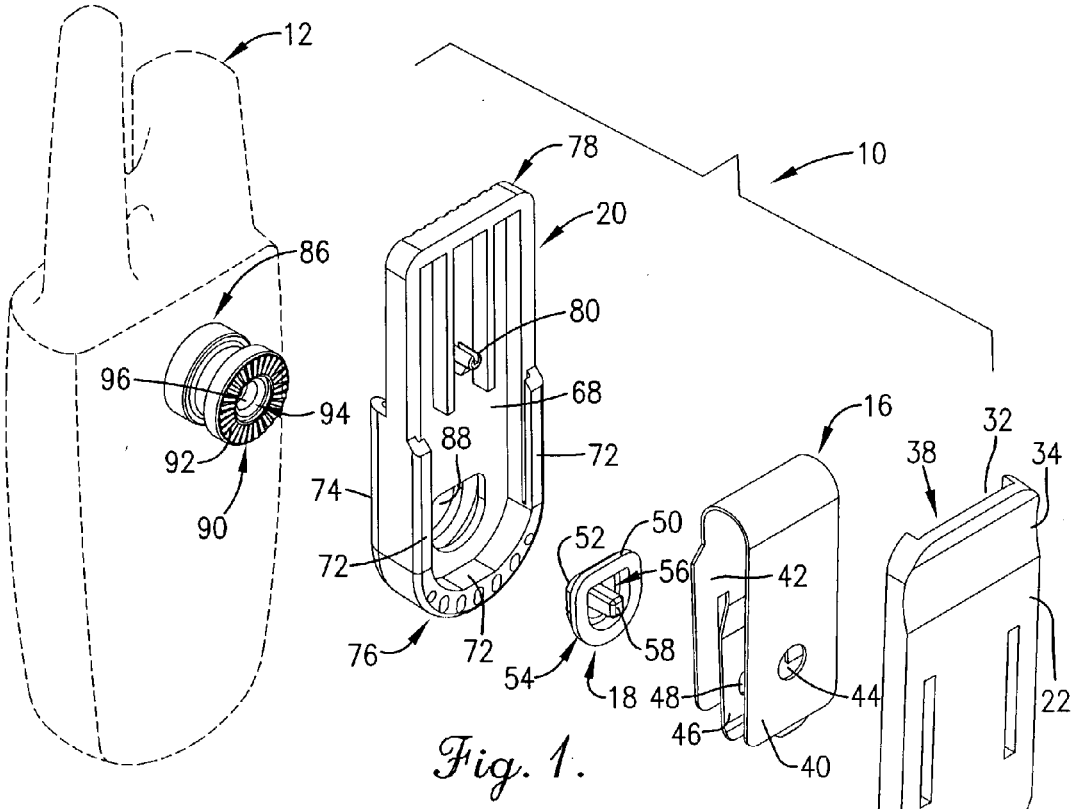
FIG. 1 is a an exploded view of a carrying assembly constructed in accordance with a first preferred embodiment of the present invention, including a locking button secured to an electronic device.

Turning now to the drawings, and particularly FIGS. 1–6, a carrying assembly 10 constructed in accordance with a first preferred embodiment of the present invention is illustrated. The carrying assembly 10 is particularly adapted for securing an electronic device 12, such as a mobile telephone, a GPS receiver unit, a PDA, or a pager, to a user's belt or a waist of the user's pants. As can best be seen in FIGS. 1 (in view from right to left) and 2 (in view from left to right), the carrying assembly 10 broadly comprises a rear panel 14, a spring component 16, a retainer button 18, and a base 20.

The rear panel 14 is generally rectangular in shape and has opposed planar rear and front faces 22 and 24, respectively, a first and a second side wall 26 and 28, respectively, a bottom wall 30, and a top wall 32. The rear face 22 preferably includes a trough-like shallow indentation 34 for receipt of the user's fingers in placement or removal of the carrying assembly 10. The first side wall 26 is preferably provided with a first inwardly-projecting flange portion (not shown) shorter in length than a length of the first side wall 26. Similarly, the second side wall 28 is preferably provided with a second inwardly-projecting flange portion 36 shorter in length than a length of the second side wall 28.

The bottom wall 30 preferably extends beyond each side wall 26,28 so as to facilitate placement and securement of the carrying assembly 10 on the user's clothing. Each side wall 26,28 extends a length of the rear panel 14 to form a recess 38 in the top wall 32, the purpose of which is described below. The front face 24 preferably includes a ramped boss (not shown) for securement of the rear panel 14 with the spring component 16, as described below. The rear panel 14 is preferably made of PC/ABS, but could be made of any other suitable material, such as nylon, aluminum, or mild steel.

The spring component 16 is substantially U-shaped in cross-section and is preferably made of steel, but other suitable materials may be used, such as rigid plastic. The spring component 16 includes a rear wall 40 and a front wall 42, and the rear wall 40 includes a first generally circularly-shaped opening 44. The front wall 42 of the spring component 16 includes a second generally circularly-shaped opening (not shown) for securement of the base 20 with the spring component 16, as described below. The front wall 42 also includes an integral sloped leaf spring 46 for providing tension once pressure is applied to the retainer button 18, as described below.

Figure 5:
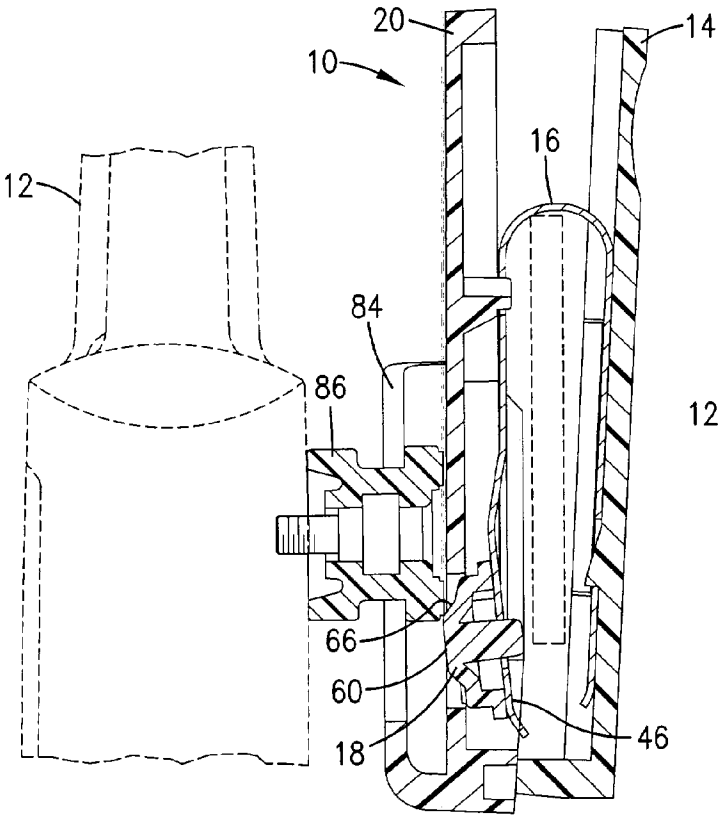
FIG. 5 is a horizontal cross-sectional view of the carrying assembly illustrating the electronic device secured to the locking button, wherein the locking button is received within a U-shaped flange of the carrying assembly such that the leaf spring is downwardly displaced.
Figure 4:
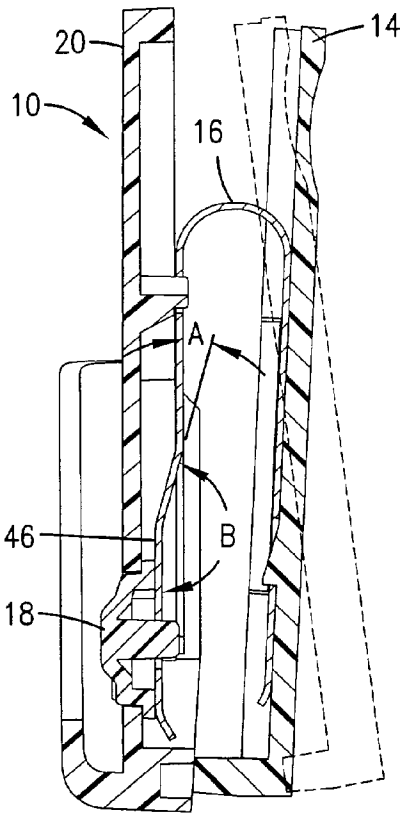
FIG. 4 is a horizontal cross-sectional view of the carrying assembly illustrating a retainer button and a spring component with an integral leaf spring in an original, non-displaced position.

As illustrated in FIG. 4, the leaf spring 46 is preferably angled at two locations, A and B. Angle A is preferably approximately 15°, but may range between 5° and 30°. Angle B is preferably approximately 165°, but may range between 150° and 175°. The leaf spring 46 includes a third generally circularly-shaped opening 48, the purpose of which is described below. The leaf spring 46 is adapted to be downwardly displaced upon insertion of the electronic device 12 into the carrying assembly 10, as described below, and as illustrated in FIG. 5.

The spring component 16 is secured to the rear panel 14 by sliding the spring component 16 through the recess 38 formed in the top wall 32 of the rear panel 14 and under the first flange portion (not shown), under the second flange portion 36, and over the ramped boss (not shown). The ramped boss (not shown) is then fitted through the first circular opening 44.

Turning again to FIGS. 1 and 2, the retainer button 18 includes a rear plate 50 and a front plate 52 and is preferably partially hollowed. The retainer button 18 is preferably made of PC/ABS, but other suitable materials may be used, such as nylon, aluminum, or mild steel. The rear plate 50 includes a rear face 54 and a front face (not shown). The rear face 54 preferably has an opening 56 through which a longitudinally-projecting tab 58, secured to an underside of the retainer button 18, projects. The longitudinally-projecting tab 58 preferably gradually decreases in width so that it may be fitted through the third circular opening 48 in the leaf spring 46 for securement of the retainer button 18 with the spring component 16.

Figure 2:
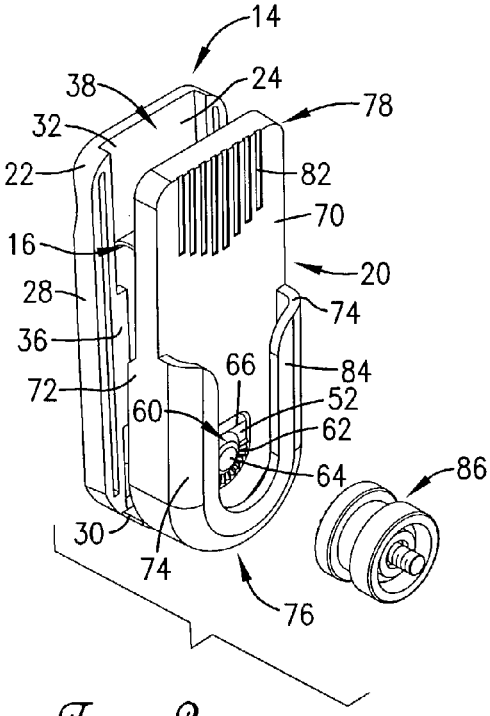
FIG. 2 is a front and side perspective view of the carrying assembly of the first preferred embodiment, including the locking button.

The font plate 52 of the retainer button 18, as illustrated in FIG. 2, is preferably substantially similar in shape to the rear plate 50 and smaller in area than the rear plate 50. The front plate 52 is preferably formed to the front face (not shown) of the rear plate 50. The front plate 52 is provided with an upwardly projecting retainer portion 60 and a plurality of serrated teeth 62 for rotational adjustment of the electronic device 12, as described below. The upwardly projecting retainer portion 60 is preferably conically-shaped, such that a wide end of the cone faces towards the front plate 52, and a narrow end of the cone is cut away so that the a top portion 64 of the retainer portion 60 is preferably substantially flat.

The serrated teeth 62 preferably lie in a substantially semi-circular shape or approximately 180 span, as illustrated in FIG. 2, around the retainer portion 60 and opposite an angled face 66 of the front plate 52. There are preferably approximately 15 teeth 62 within the 180 span, with each tooth having an approximate 12 pitch, but the amount of teeth 62 may range between 5 teeth and 30 teeth, and the pitch angle may range between 5 and 30. Other pitch angles and fewer or more teeth 62 may be used depending on the size of the retainer button 18.

The base 20 has opposed rear and front faces 68 and 70, respectively, a rear wall 72, a front wall 74, a substantially U-shaped bottom portion 76, and a top portion 78. The rear face 68 is provided with a snapping projection 80, the purpose of which is described below. A plurality of parallel, spaced-apart indentations 82 is provided on the front face 70 of the top portion 78, the purpose of which is described below. The rear wall 72 preferably substantially surrounds the U-shaped bottom portion 76 of the rear face 68. Similarly, the front wall 74 preferably substantially surrounds the U-shaped bottom portion 76 of the front face 70. The front wall 74 is preferably provided with a U-shaped flange 84 for receipt of a locking button 86, as described below. The base 20 is secured to the spring component 16 via the snapping projection 80, which is fitted through the second circular opening (not shown) in the spring component 16. The base 20 is preferably made of PC/ABS, but other suitable materials may be used, such as nylon, aluminum, or mild steel.

An opening 88 is preferably provided in the U-shaped bottom portion 76 for receipt of the retainer button 18. The opening 88 is preferably substantially the same shape and area of the front plate 52 of the retainer button 18. The retainer button 18 may be fitted through the opening 88 such that the front plate 52 protrudes beyond the front face 70 of the base 20. The angled face 66 of the retainer button 18 is then exposed such that the locking button 86 may more easily overcome the retainer portion 60 and marry or lock with the serrated teeth 62 of the retainer button 18, as described below.

Figure 6:
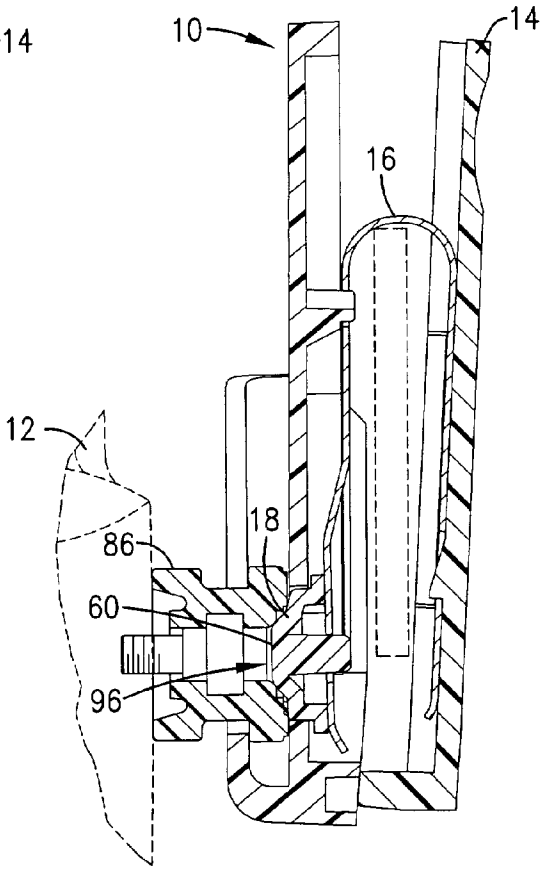
FIG. 6 is a horizontal cross-sectional view of the carrying assembly illustrating a retainer portion of the retainer button positioned within a hollowed portion of the locking button for securement of the electronic device with the carrying assembly.

The locking button 86 is preferably secured to the electronic device 12 using any suitable means, such as permanent adhesive or at least one screw, or the electronic device 12 may be manufactured with the locking button 86 attached. The locking button 86 is preferably substantially circular in shape, but the locking button 86 may be differently shaped, such as U-shaped or oval shaped. An underside 90 of the locking button 86 (see FIG. 1) is preferably provided with a plurality of serrated teeth 92. Preferably, the teeth 92 are of the same pitch as the serrated teeth 62 on the retainer button 18. In the preferred embodiment, there are preferably 30 teeth 92 equally spaced around the locking button 86 in a full 360 span, but the amount of teeth 92 may range between 15 teeth and 60 teeth. Each tooth preferably has a 12 pitch, but the pitch may range between 5 and 30. The amount of teeth 92 and each tooth's pitch is dependent on the size of the locking button 86. The teeth 92 are preferably circularly-positioned around the locking button 86 such that a circular opening 94 is provided on the underside 90 of the locking button 86. The locking button 86 is preferably partially hollowed such that the retainer portion 60 of the retainer button 18 is fitted through the circular opening 94 and within a hollowed portion 96 when the locking button 86 is slid within the U-shaped flange 84 of the base 20, as illustrated in FIGS. 1, 5, and 6, and as described below.

As noted above, the base 20 includes parallel indentations 82, which provide a guide on which the locking button 86 may travel for easier placement of the locking button 86 in the U-shaped flange 84. The locking button 86 is preferably of a diameter that the locking button 86 may easily slide within the U-shaped flange 84, yet may also not be of such a small diameter that the locking button 86 is not secured within the U-shaped flange 84. The locking button 86 is preferably made of PC/ABS or other suitable materials, such as nylon, aluminum, or mild steel.

In operation, the user of the carrying assembly 10 inserts the locking button 86, with electronic device 12 attached, into the U-shaped flange 84 of the base 20. The user applies pressure to the locking button 86 so that the locking button 86 slides up and over the angled face 66 of the retainer button 18 and then over the upwardly-projecting retainer portion 60. The locking button 86 is capable of sliding over the retainer portion 60 due to the tension in the leaf spring 46. When pressure is indirectly applied to the retainer portion 60, the retainer portion 60 is downwardly displaced since the leaf spring 46 is adapted to be downwardly displaced, as illustrated in FIG. 5. The tension in the leaf spring 46 then displaces the retainer portion 60 back to its beginning position once the locking button 86 has overcome the retainer portion 60, as illustrated in FIG. 6. The retainer portion 60 is then fitted within the hollowed portion 96 of the locking button 86, and the serrated teeth 92 of the locking button 86 are married with the serrated teeth 62 of the retainer button 18. To remove the locking button 86 from the U-shaped flange 84 of the base 20, the user pulls the locking button 86 with enough force that the serrated teeth 62,92 of the retainer button 18 and the locking button 86, respectively, are separated and the locking button 86 overcomes the retainer portion 60.

Figure 3:
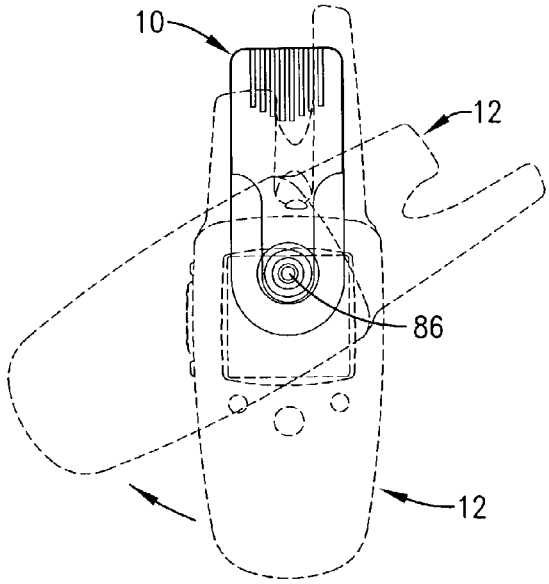
FIG. 3 is a front elevational view of the carrying assembly of the first preferred embodiment schematically depicting rotational adjustment of the electronic device.

The carrying assembly 10 is also adjustable since the electronic device 12 may be rotated to a horizontal position, a vertical position, or any position in between, as illustrated in FIG. 3. Once the serrated teeth 62,92 of the retainer button 18 and the locking button 86, respectively, are married, the user of the carrying assembly 10 may rotate the electronic device 12 by simply applying enough force so that the serrated teeth 92 of the locking button 86 overcome the serrated teeth 62 of the retainer button 18. The pitch of each tooth is thus of particular importance since the pitch must be steep enough to securely marry the teeth 62,92 together but angled enough to allow the user to easily apply force to overcome the securement of the teeth 62,92.

Figure 7:
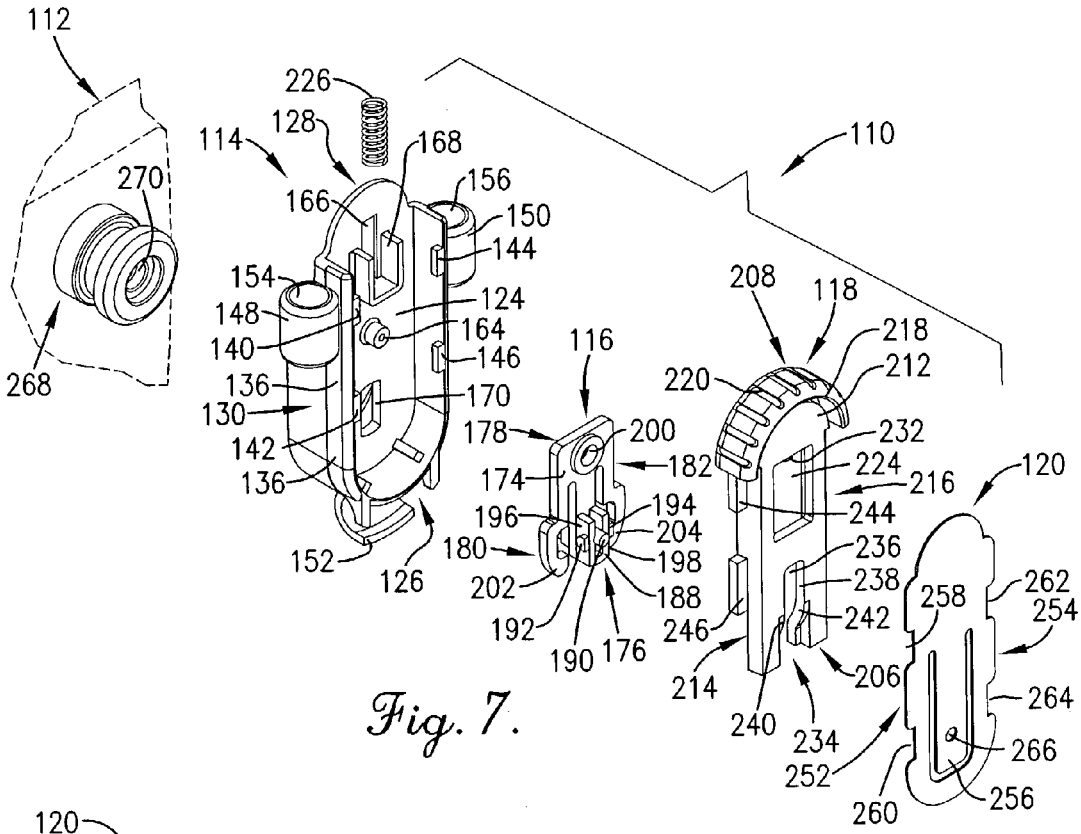
FIG. 7 is a rear exploded view of a carrying assembly constructed in accordance with a second preferred embodiment of the present invention, including a locking button secured to an electronic device.
Figure 8:
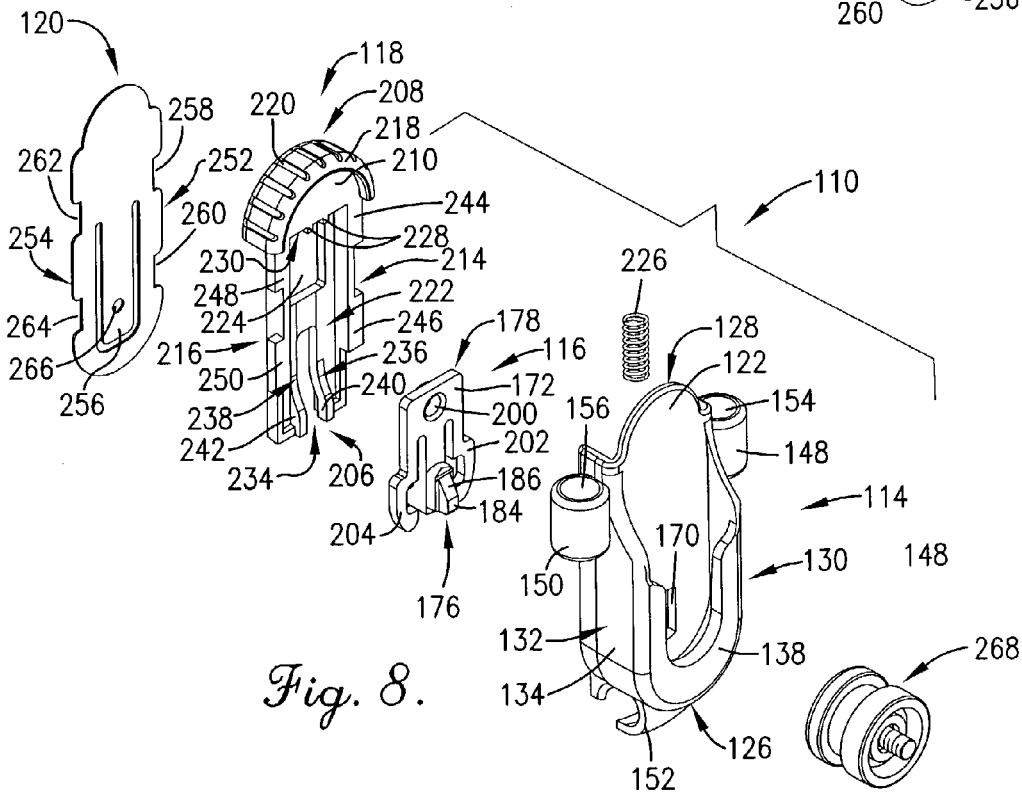
FIG. 8 is a front exploded view of the carrying assembly of the second preferred embodiment, including the locking button.
Figure 9:
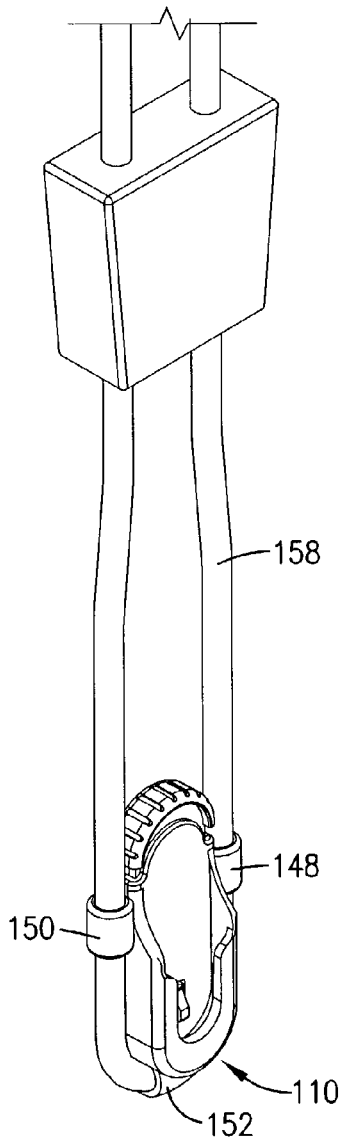
FIG. 9 is a front and side perspective view of the carrying assembly fitted to a lanyard.

Turning now to FIGS. 7–13, in a second preferred embodiment, the carrying assembly 110 is a lanyard for carrying the electronic device 112 around the user's neck, as illustrated in FIG. 9. As can best be seen in FIGS. 7 (in view from left to right) and 8 (in view from right to left), the carrying assembly 110 broadly comprises a base 114, a catch 116, an actuator 118, and a rear panel 120. The above four components are all preferably made of PCS/ABS, but other suitable materials may be used, such as nylon, aluminum, or mild steel.

The base 114 is generally oval in shape and has a front face 122, a rear face 124, a generally U-shaped bottom portion 126, a top portion 128, a first side 130, a second side 132, a front wall 134, and a rear wall 136, as illustrated in FIGS. 7 and 8. The front face 122 of the U-shaped bottom portion 126 and the first and the second sides 130,132 is substantially surrounded by the front wall 134. The front wall 134 is provided with a U-shaped flange 138, the purpose of which is described below. The rear face 124 of the U-shaped bottom portion 126 and the first and the second sides 130,132 is substantially surrounded by the rear wall 136. The rear wall 136 is preferably provided with a first flange portion 140, a second flange portion 142, a third flange portion 144, and a fourth flange portion 146 for guiding and placement of the rear panel 120, as described below.

A first tubular side ring 148 and a second tubular side ring 150 are secured on the first and the second sides 130,132 of the base 114, respectively, such that the side rings 148,150 are generally opposite each other. A tubular end ring 152 is positioned on the U-shaped bottom portion 126 of the base 114. The first and the second tubular side rings 148,150 are fully enclosed, whereby the first tubular side ring 148 has a first opening 154 and the second tubular side ring 150 has a second opening 156. A cord 158 may be ran through the first and the second openings 154,156 as illustrated in FIG. 9. The tubular end ring 152 is partially enclosed, so that the cord 158 may be "snapped" into position. The tubular rings 148,150,152 are preferably made of hard plastic, but other suitable materials may be used. The cord 158 is preferably made of nylon and has a first end 160 and a second end 162. The first and the second ends 160,162 are each preferably melted into a hard end. The first and the second ends 160,162 are then preferably joined using a quick-release safety clasp 163 preferably made of rubber tubing. The safety clasp 163 is operable to come apart under stress.

The rear face 124 of the base 114 is provided with a circular projection 164 approximately mid-length of the base 114 for securing the catch 116 to the base 114, as described below. The rear face 124 of the base 114 is also provided with a generally rectangularly-shaped cavity 166 near the top portion 128 of the base 114. A first generally U-shaped projection 168 partially surrounds the rectangular cavity 166, the purpose of which is described below. The base 114 is also provided with a first generally rectangularly-shaped opening 170 near the U-shaped bottom portion 126, the purpose of which is also described below.

The catch 116 has a front face 172, a rear face 174, a bottom end 176, a top end 178, a first side 180, and a second side 182. The front face 172 is provided with a retainer portion 184 near the bottom end 176. The retainer portion 184 preferably includes at least one angled face 186 of approximately 30°, the purpose of which is described below. The rear face 174 is provided with a second generally U-shaped projection 188 near the bottom end 176 and generally opposite the retainer portion 184. A longitudinally-projecting piece 190 is centrally positioned within the second U-shaped projection 188. A first boss 192 and a second boss 194 are provided on a first outer face 196 and a second outer face 198, respectively, of the second U-shaped projection 188. A first generally circularly-shaped opening 200 is provided near the top end 178 of the catch 116 for insertion of the circular projection 164 provided on the base 114. A first claw-shaped clamping arm 202 is provided on the first side 180 of the catch 116, and a second claw-shaped clamping arm 204 is provided on the second side 182 of the catch 116.

The catch 116 is secured to the base 114 by "snapping" the circular projection 164 into the first circular opening 200 of the catch 116. The catch 116 is positioned so that the retainer portion 184 fits through the first rectangular opening 170 of the base 114 and protrudes beyond the front face 122 of the base 114.

The actuator 118 has a bottom end 206, a semi-circularly-shaped top end 208, a front face 210, a rear face 212, a first side 214, and a second side 216. Once the carrying assembly 110 is assembled, the bottom end 206 is positioned near the U-shaped bottom portion 126 of the base 114. The semi-circular top end 208 includes a rigid grasping component 218 having equally-spaced parallel indentations 220 provided thereon to facilitate grasping of the actuator 118. The grasping component 218 is formed in a semi-circular shape so that the user of the carrying assembly 110 may grasp the actuator 118 with his or her fingers and compress horizontally, as described below.

The actuator 118 includes a generally rectangularly-shaped recess 222 within which a second generally rectangularly-shaped opening 224 is located near the semi-circular top end 208 for positioning of a coil spring 226. To further facilitate positioning of the coil spring 226, a pair of shoulder tabs 228 is located on an underside 230 of the recess 222 near the top end 208. Positioned within the second rectangular opening 224 and generally opposite the pair of shoulder tabs 228 is a semi-circularly-shaped boss 232. Upon assembly of the carrying assembly 110, the coil spring 226 is fitted within the rectangular cavity 166 and the first U-shaped projection 168 of the base 114. The first U-shaped projection 168 then fits within the second rectangular opening 224 of the actuator 118, such that the coil spring 226 is positioned around the semi-circular boss 232 and supported by the shoulder tabs 228.

The bottom end 206 of the actuator 118 includes an elongated U-shaped slit 234 having a first side 236 and a second side 238. A first rail 240 is provided on the first side 236, and a second rail 242 is provided on the second side 238. Each rail 240,242 is angled preferably approximately 30° from the front face 210 of the actuator 118, such that the rails 240,242 project outwardly from the front face 210 of the actuator 118.

The first side 214 of the actuator 118 is provided with a first rectangularly-shaped projection 244 and a second rectangularly-shaped projection 246. Similarly, the second side 216 of the actuator 118 is provided with a third rectangularly-shaped projection 248 and a fourth rectangularly-shaped projection 250, such that the first and the second rectangular projections 244,246 are generally opposite the third and the fourth rectangular projections 248,250. Once the carrying assembly 110 is assembled, the first and the second rectangular projections 244,246 substantially abut the first and the second flange portions 140,142, respectively, on the base 114. Similarly, the third and the fourth rectangular projections 248,250 substantially abut the third and the fourth flange portions 144,146, respectively, on the base 114. The second U-shaped projection 188 on the catch 116 is then fitted within the elongated U-shaped slit 234 of the actuator 118. The first grasping arm 202 grasps the first rail 240, and the second grasping arm 204 grasps the second rail 242. Upon movement of the actuator 118 horizontally towards the U-shaped bottom portion 126 of the base 114, the first and the second bosses 192,194 ride under and along the first and the second rails 240,242, respectively, as illustrated in FIGS. 7 and 10–13. This in turn downwardly displaces the second U-shaped projection 188 and corresponding retainer portion 184.

The rear panel 120 is preferably generally oval in shape and similar to the shape of the base 114. The rear panel 120 is substantially flat with no protrusions and is designed to fit within the rear wall 136 of the base 114. The rear panel 120 includes a first side 252, a second side 254, and an integral leaf spring 256. The first side 252 is preferably provided with a first horizontal notch 258 and a second horizontal notch 260. Similarly, the second side 254 is provided with a third horizontal notch 262 and a fourth horizontal notch 264. Once the carrying assembly 110 is assembled, the first and the second horizontal notches 258,260 align with the first and the second flange portions 140,142, respectively, and the third and the fourth horizontal notches 262,264 align with the third and the fourth flange portions 144,146, respectively.

The leaf spring 256 includes a second circular opening 266, whereby the longitudinally-projecting piece 190 of the catch 116 is fitted through the second circular opening 266 for securement of the rear panel 120 with the catch 116. In operation, the leaf spring 256 provides tension for displacement of the retainer portion 184, as described below.

Figure 12:
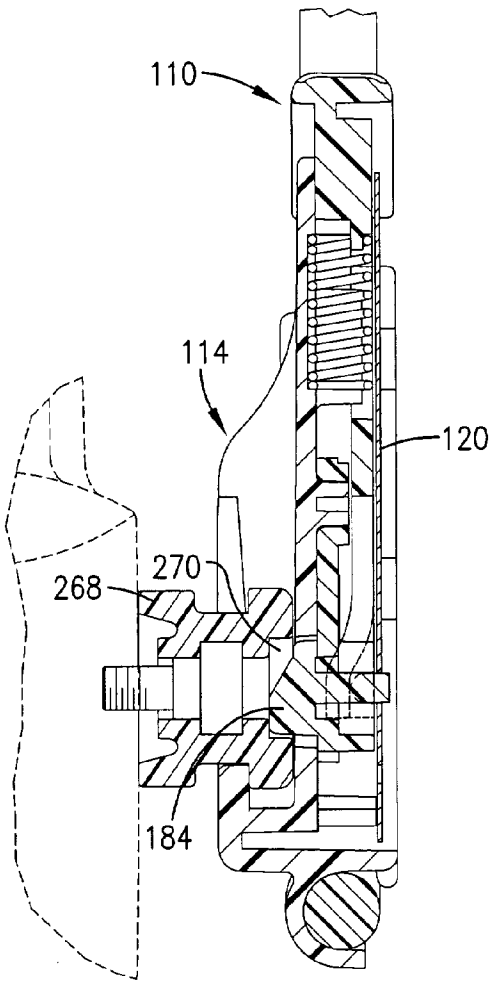
FIG. 12 is a horizontal cross-sectional view of the carrying assembly illustrating the locking button fully overcoming the retainer portion, wherein the locking button is secured within the carrying assembly.
Figure 11:
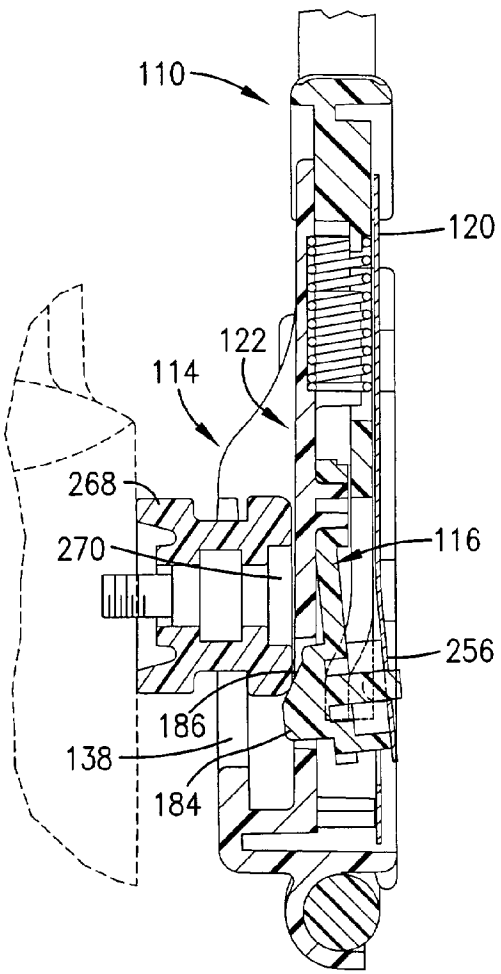
FIG. 11 is a horizontal cross-sectional view of the carrying assembly illustrating the locking button partially overcoming a retainer portion of a catch.

Similar to the first preferred embodiment, a locking button 268 is secured to the electronic device 112 using permanent adhesive or at least one screw. The locking button 268 is preferably circular in shape, but may be differently shaped, such as U-shaped or oval. Similar to the first preferred embodiment, the locking button 268 preferably includes a hollowed portion 270, whereby the retainer portion 184 is fitted within the hollowed portion 270 upon securement of the locking button 268 in the U-shaped flange 138 of the base 114, as illustrated in FIGS. 11 and 12, and as described below.

Figure 10:
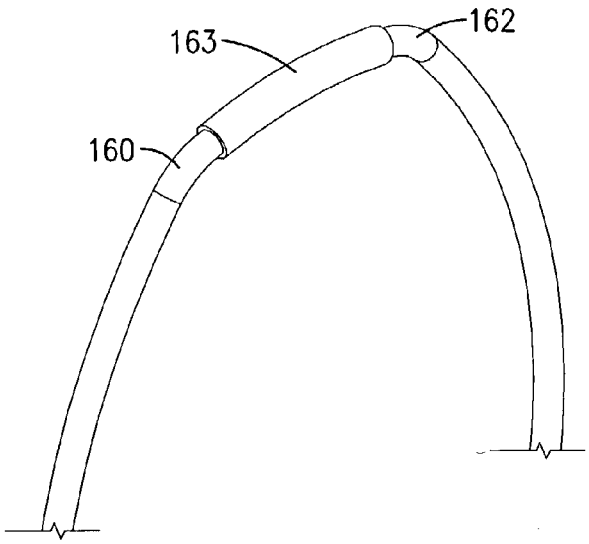
FIG. 10 is a horizontal cross-sectional view of the carrying assembly illustrating an electronic device secured to the locking button, wherein the locking button is partially positioned within the carrying assembly.
Figure 10:
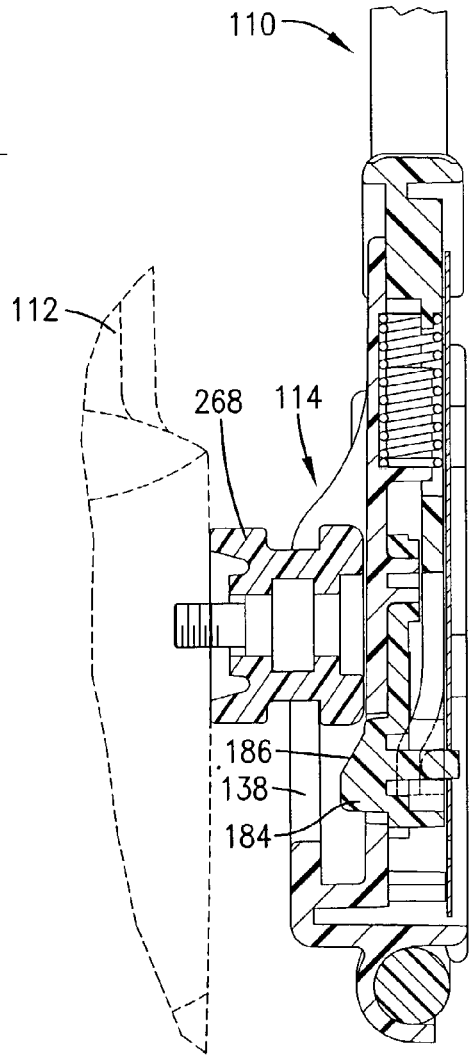

In operation, the user of the carrying assembly 110, similar to the first preferred embodiment, inserts the locking button 268, with electronic device 112 attached, into the U-shaped flange 138 of the base 114, as illustrated in FIG. 10. The user applies pressure to the locking button 268 so that the locking button 268 slides up and over the angled face 186 of the retainer portion 184, as illustrated in FIGS. 11 and 12. The locking button 268 is capable of sliding over the retainer portion 184 due to the tension in the leaf spring 256. The retainer portion 184 is downwardly displaced upon application of indirect pressure to the locking button 268, which in turn downwardly displaces the leaf spring 256, as illustrated in FIG. 11. The retainer portion 184 is then displaced below the front face 122 of the base 114, which allows the locking button 268 to slide past the retainer portion 184. Since the leaf spring 256 is under tension, the leaf spring 256 is displaced back to its beginning position once the retainer portion 184 is fitted within the hollowed portion 270 of the locking button 268, which then secures the locking button 268 in place, as illustrated in FIG. 12.

Figure 13:
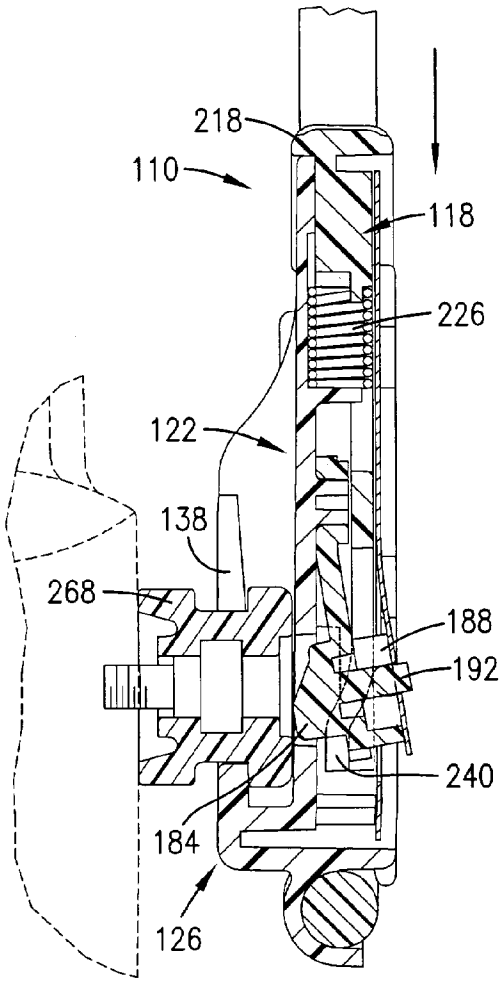
FIG. 13 is a horizontal cross-sectional view of the carrying assembly illustrating forward horizontal movement of an actuator to allow for removal of the locking button from the carrying assembly.

To remove the electronic device 112 from the carrying assembly 110, the user must slide the locking button 268 out from the U-shaped flange 138. To accomplish this, the user depresses the actuator 118 by grasping and applying pressure to the grasping component 218. This in turn compresses the coil spring 226 and actuates the rails 240,242 horizontally towards the U-shaped bottom portion 126 of the base 114, as illustrated in FIG. 13. As discussed above, the first and the second rails 240,242 then ride along and above the first and the second bosses 192,194, respectively. Due to the angle at which the rails 240,242 are positioned, the second U-shaped projection 188 and corresponding retainer portion 184 are downwardly displaced. Once the retainer portion 184 is displaced below the front face 122 of the base 114, the locking button 268 may easily be slid from the U-shaped flange 138, and the electronic device 112 may be removed. Due to the tension of the coil spring 226, the actuator 118 is displaced backed to its original position, such that the retainer portion 184 is returned to its original position protruding beyond the front face 122 of the base 114.

From the preceding description, it can be seen that the carrying assemblies 10,110 for an electronic device 12,112 of the present invention allow for easier access, insertion, removal, and positioning of the electronic device 12,112. Additionally, since the present invention has fewer components than prior art devices, the present invention may be more economically produced so that its cost does not detract from the overall price of carrying assemblies 10,110 for electronic devices 12,112, thereby rendering the user less willing to purchase such a carrying assembly 10,110. Although the invention has been described with reference to the preferred embodiments illustrated in the attached drawings, equivalents may be employed and substitutions made herein without departing from the scope of the invention as recited in the claims. For example, the carrying assemblies 10,110 of the first and the second preferred embodiments may be sized to accommodate specific electronic devices 12,112. Additionally, the carrying assembly 10 of the first preferred embodiment, although designed to be clipped to a waist of the user's pants or skirt, may be clipped to any other suitable article, such as a briefcase or a purse. The rear panel 14 of the first preferred embodiment may also be provided with either repositionable or permanent adhesive for placement of the carrying assembly 10 and corresponding electronic device 12 on a surface, such as a dashboard of an automobile.

Having thus described the preferred embodiment of the invention, what is claimed as new and desired to be protected by Letters Patent includes the following:

1. A carrying assembly for an electronic device, the carrying assembly comprising:

a base including an opening and a flange portion for receipt of a locking button;

a retainer button provided with a plurality of serrated teeth;

a retainer portion positioned on the retainer button and adapted to protrude through the opening for securement of the locking button in the flange portion; and a leaf spring associated with the base and operable to provide tension for displacement of the retainer portion.

2. The carrying assembly as set forth in claim 1, wherein an underside of the locking button is provided with a plurality of serrated teeth for matching of the serrated teeth provided on the retainer button.

3. The carrying assembly as set forth in claim 1, further including an actuator adapted to displace the retainer portion so that the locking button may be removed from the flange portion of the base.

4. An adjustable carrying assembly for securement of an electronic device, the carrying assembly comprising:

a generally rectangular rear pair provided with a pair of side walls and an end wall, wherein each side wall has an inwardly projecting flange portion shorter than a length of each side wall;

a spring component associated with the rear panel, the spring component including an integral leaf spring, wherein the spring component is substantially U-shaped in cross-section and is adapted to be received in the flange portions of the rear panel;

a retainer button associated with the spring component and having a retainer portion provided thereon, wherein the retainer button has a rear plate, a front plate, a rear face, an area, and a shape, and the rear face has an opening through which a longitudinally projecting tab, secured to an underside of the retainer button, projects outwards for securement of the retainer button with the leaf spring; and a base having an opening and a flange for receipt of a locking button, whereby the retainer portion is adapted to protrude through the opening for positioning within a hollowed portion of the locking button, wherein the leaf spring provides tension for insertion and removal of the locking button.

5. The carrying assembly as set forth in claim 4, wherein the front plate of the retainer button is formed to the rear plate, and the front plate is substantially similar in shape and smaller in area than the rear plate.

6. The carrying assembly as set forth in claim 5, wherein an underside of the rear plate is provided with a plurality of serrated teeth for rotational adjustment of the electronic device.

7. The carrying assembly as set forth in claim 6, wherein an underside of the locking button is provided with a plurality of serrated teeth for marrying of the teeth provided on the retainer button.

8. The carrying assembly as set forth in claim 7, wherein the base has a rear face, a front face, and a substantially U-shaped bottom portion.

9. The carrying assembly as set forth in claim 8, wherein a front wall substantially surrounds the U-shaped bottom portion of the front face, and a rear wall substantially surrounds the U-shaped bottom portion of the rear face.

10. The caring assembly as set forth in claim 9, wherein the locking button is adapted to slide over the retainer portion upon application of generally horizontal pressure to the locking button.

11. An adjustable carrying assembly for securement of an electronic device, the carrying assembly comprising:

a rear panel having a pair of side walls and a pair of inwardly projecting flange portions provided on each side wall;

a spring component adapted to be received in the flange portions of each side wall, the spring component having a sloped integral leaf spring;

a retainer button adapted to be fitted to the spring component, the retainer button including an upwardly projecting retainer portion for securement of a locking button secured to the electronic device and a plurality of serrated teeth for rotational adjustment of the electronic device; and a base, a portion of which is provided with a flange for receipt of the locking button.

12. The carrying assembly as set forth in claim 11, wherein an underside of the locking button is provided with serrated teeth for marrying of the serrated teeth of the retainer button.

13. The carrying assembly as set forth in claim 12, wherein the locking button is adapted to slide over the upwardly projecting retainer portion upon application of generally horizontal pressure to the locking button.

14. An adjustable carrying assembly for securement of an electronic device, the carrying assembly comprising:

a generally rectangularly-shaped rear panel having a pair of side walls and an end wall extending beyond each side wall, wherein each side wall has an inwardly projecting flange portion shorter than a length of each side wall;

a spring component substantially U-shaped in cross-section and adapted to be received in the flange portions of the rear panel, the spring component having a sloped integral leaf spring for providing tension;

a retainer button associated with the spring component, the retainer button including— a substantially flat rear plate having a rear face, an area, and a shape, the rear face having an opening, wherein a longitudinally-projecting tab secured to an underside of the retainer button projects outwardly through the opening for securement of the retainer button with the leaf spring, and a front plate substantially similar in shape to the rear plate, smaller in area than the rear plate, and formed to the rear plate, the front plate including an upwardly projecting retainer portion and a plurality of serrated teeth for rotational adjustment of the electronic device; and a base having a substantially U-shaped bottom portion, the base including— a rear wall provided on a rear face of the base and substantially surrounding the U-shaped bottom portion of the base, a front wall provided on a front face of the base and substantially surrounding the U-shaped bottom portion of the base, a substantially U-shaped flange provided on the front wall and adapted for receipt of a locking button secured to the electronic device, and an opening formed in the U-shaped bottom portion of the base and adapted to partially receive the retainer button therethrough.

15. The carrying assembly as set forth in claim 14, wherein an underside of the locking button is provided with serrated teeth for marrying of the serrated teeth of the retainer button.

16. The carrying assembly as set forth in claim 15, wherein the locking button is adapted to slide over the upwardly projecting retainer portion upon application of generally horizontal pressure to the locking button.

17. A method for securing an electronic device, the method comprising the steps of:

inserting a locking button having an electronic device secured thereto, within a carrying assembly base having an opening wherein an underside of the locking button is provided with a plurality of serrated teeth;

applying pressure to the locking button to overcome a retainer portion protruding through the opening in the base, wherein the retainer portion is operable to be downwardly displaced; and returning the retainer portion to its original position due to the tension in a leaf spring.

18. The method as set forth in claim 17, wherein the retainer portion is positioned on a retainer button, and the retainer button is provided with a plurality of serrated teeth for matching with the serrated teeth of the locking button upon insertion of the locking button in the carrying assembly.

19. The method as set forth in claim 17, further including the step of horizontally compress an actuator so as to downwardly displace the retainer portion for removal of the locking button from the carrying assembly.

* * * * *